US012102893B2

(12) United States Patent
Takahashi et al.

(10) Patent No.: US 12,102,893 B2
(45) Date of Patent: Oct. 1, 2024

(54) GOLF CLUB HEAD AND SET OF GOLF CLUBS

(71) Applicant: BRIDGESTONE SPORTS CO., LTD., Tokyo (JP)

(72) Inventors: Hiroshi Takahashi, Tokyo (JP); Takaharu Takechi, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 6 days.

(21) Appl. No.: 18/060,751

(22) Filed: Dec. 1, 2022

(65) Prior Publication Data

US 2023/0201679 A1 Jun. 29, 2023

(30) Foreign Application Priority Data

Dec. 23, 2021 (JP) ..... 2021-209204

(51) Int. Cl.
*A63B 53/04* (2015.01)

(52) U.S. Cl.
CPC ..... *A63B 53/0475* (2013.01); *A63B 53/0408* (2020.08); *A63B 53/0445* (2020.08)

(58) Field of Classification Search
CPC ..... A63B 53/0475; A63B 53/0445; A63B 53/0408
See application file for complete search history.

(56) References Cited

U.S. PATENT DOCUMENTS

| | | | | |
|---|---|---|---|---|
| 7,131,913 | B2 * | 11/2006 | Iwata | A63B 60/00 473/350 |
| 2002/0065140 | A1 | 5/2002 | Iwata et al. | |
| 2005/0085312 | A1 * | 4/2005 | Nagai | A63B 60/02 473/291 |
| 2006/0234806 | A1 | 10/2006 | Gilbert et al. | |
| 2014/0335973 | A1 * | 11/2014 | Takechi | A63B 53/047 473/349 |
| 2016/0144247 | A1 * | 5/2016 | Chen | A63B 53/0475 29/428 |

FOREIGN PATENT DOCUMENTS

| | | |
|---|---|---|
| JP | 2006-289105 | 10/2006 |
| JP | 2012-235828 | 12/2012 |
| JP | 2014-195584 | 10/2014 |
| JP | 2014-217668 | 11/2014 |
| WO | 2002/032514 | 4/2002 |

* cited by examiner

*Primary Examiner* — Raeann Gorden
(74) *Attorney, Agent, or Firm* — IPUSA, PLLC

(57) ABSTRACT

A golf club head according to the disclosure is a cavity-back iron type golf club head that includes a face portion, a cavity portion provided behind the face portion, and a protrusion provided on a lower part of a rear face of the face portion. The protrusion includes a first recess extending from an upper surface of the protrusion toward a sole, a second recess positioned closer to a toe than the first recess is and extending from the upper surface of the protrusion toward the sole, and a thick portion provided between the first and second recesses in a toe-heel direction. The first and second recesses each has a substantially trapezoidal shape in a cross-sectional view taken along a plane that is parallel to a front face of the face portion and passes through a deepest part of each of the first and second recesses.

7 Claims, 6 Drawing Sheets

GOLF CLUB HEAD AND SET OF GOLF CLUBS

CROSS-REFERENCE TO RELATED APPLICATIONS

This application is based upon and claims priority to Japanese Patent Application No. 2021-209204 filed on Dec. 23, 2021, the entire contents of which are incorporated herein by reference.

BACKGROUND OF THE INVENTION

1. Field of the Invention

The present invention relates to golf club heads and sets of golf clubs.

2. Description of the Related Art

Conventionally, a structure in which a protrusion that is provided on the lower part of a rear face of a face portion includes a recess that extends from an upper surface of the protrusion to a sole side has been proposed in cavity-back iron type golf clubs (for example, see Japanese Patent Application Publication Nos. 2006-289105, 2012-235828, 2014-217668, 2014-195584 and PCT International Application Publication No. 2002-032514). However, while providing such a recess could improve the performance of the golf club, the reduction in the thickness around the point of impact of the face portion could lead to a loss in feel at impact.

SUMMARY OF THE INVENTION

A golf club head according to the disclosure is a cavity-back iron type golf club head that includes a face portion, a cavity portion provided behind the face portion, and a protrusion provided on a lower part of a rear face of the face portion. The protrusion includes a first recess extending from an upper surface of the protrusion to a sole side, a second recess positioned closer to a toe side than the first recess is and extending from the upper surface of the protrusion to the sole side, and a thick portion provided between the first recess and the second recess in a toe-heel direction. The first recess and the second recess each has a substantially trapezoidal shape in a cross-sectional view taken along a plane that is parallel to a front face of the face portion and that passes through a deepest part of the first recess and a deepest part of the second recess. The first recess and the second recess each gradually become deeper from a toe side toward a heel side. The thick portion is positioned behind a center line of a score line.

DETAILED DESCRIPTION OF EMBODIMENTS

An object of the present disclosure is to provide a cavity-back iron type golf club in which both performance and a good feel at impact are achieved.

According to the disclosed technique, a cavity-back iron type golf club in which both performance and a good feel at impact can be provided.

An embodiment will be described hereinafter with reference to the accompanying drawings. Note that the same reference symbols are used to denote the same components throughout the drawings, and a repetitive description thereof may be omitted.

[Golf Club Head]

Figure 1:
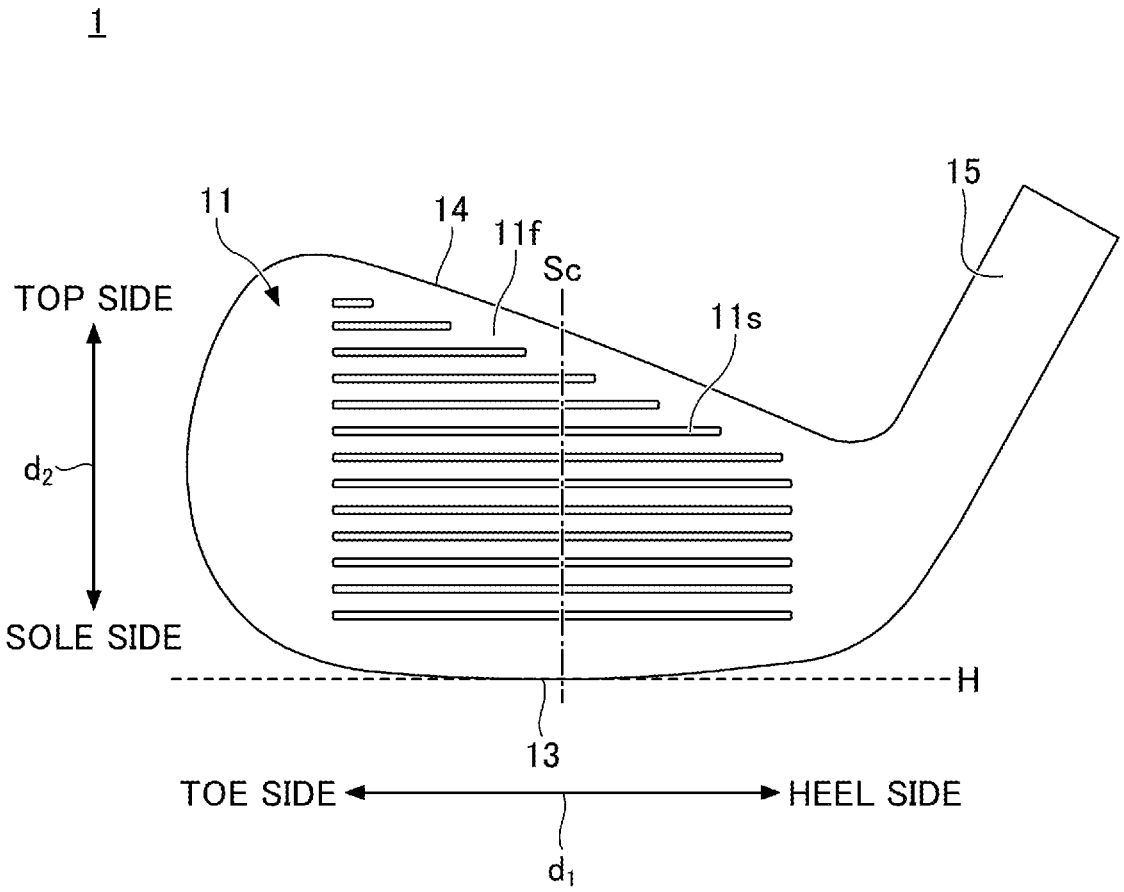
FIG. 1 is a front view illustrating an example of a golf club head according to an embodiment.
Figure 2:
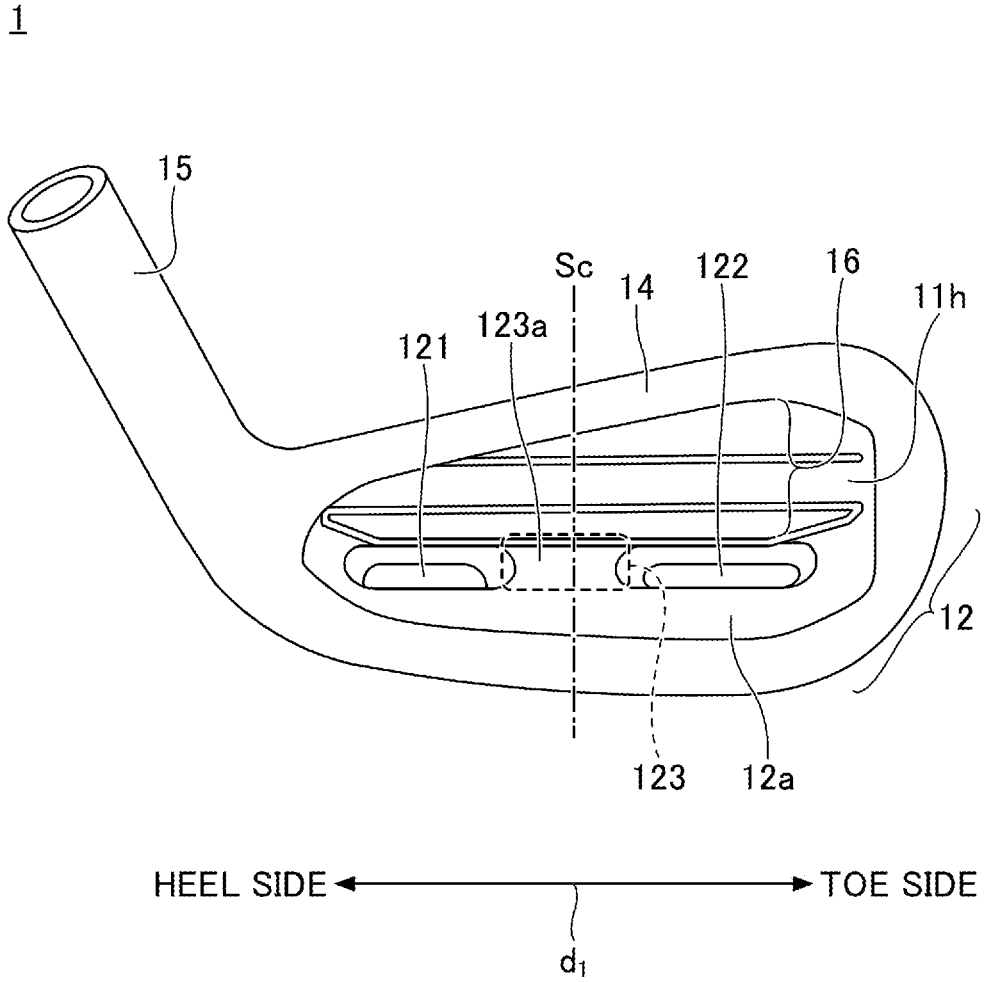
FIG. 2 is a perspective view illustrating an example of the golf club head according to the embodiment.
Figure 3:
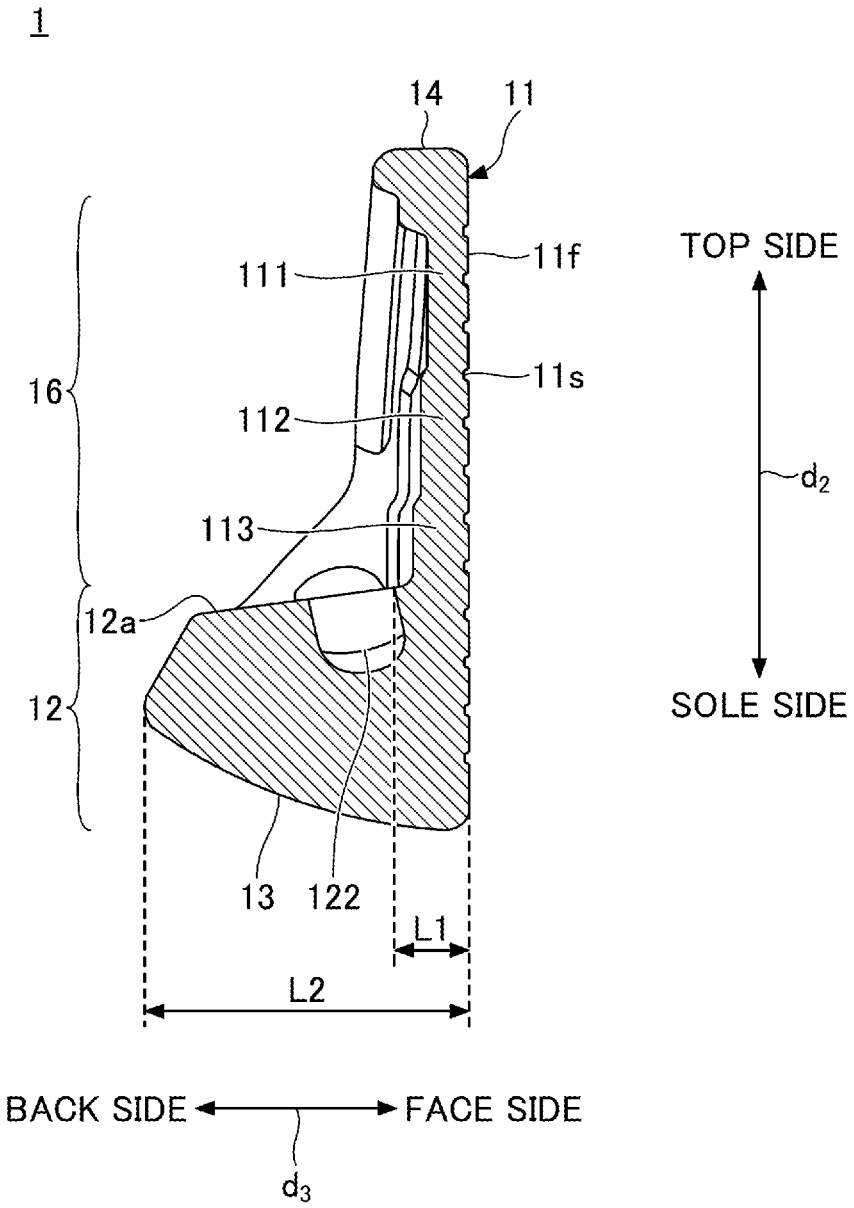
FIG. 3 is a cross-sectional view illustrating the golf club head according to the embodiment.
Figure 4:
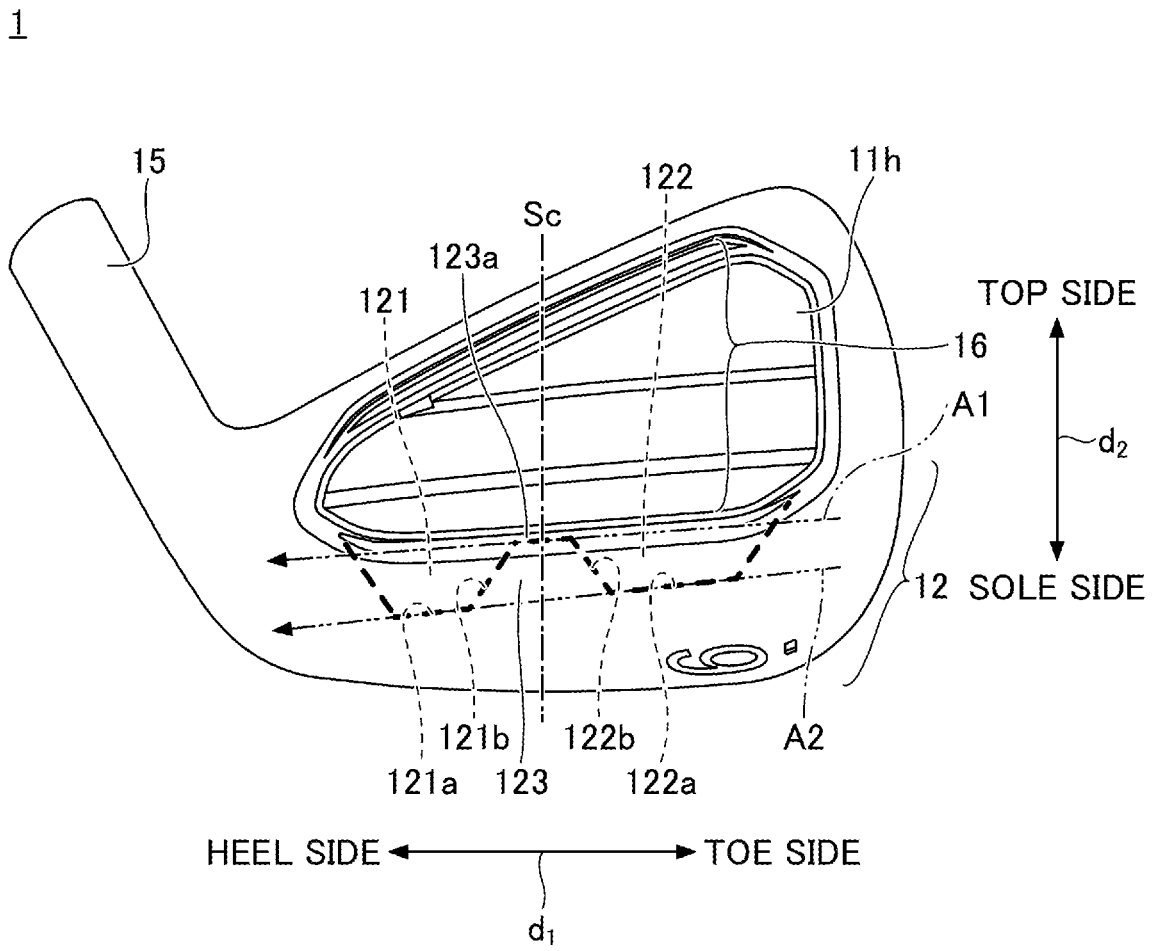
FIG. 4 is a rear view for explaining a first recess and a second recess.

FIG. 1 is a front view illustrating a golf club head according to the embodiment. FIG. 2 is a perspective view illustrating an example of the golf club head according to the embodiment, and is, more specifically, a view in which the back side of the golf club head is seen diagonally from above. FIG. 3 is a cross-sectional view illustrating the golf club head according to the embodiment, and is, more specifically, a vertical cross-sectional view taken along a face-back direction so as to pass through a second recess 122 (to be described later). FIG. 4 is a rear view for explaining a first recess and a second recess. Note that the first recess and the second recess are illustrated schematically in FIG. 4.

Note that FIG. 1 illustrates a case where a golf club head 1 rests on a horizontal plane H (corresponding to the ground) in accordance with a prescribed lie angle and a prescribed loft angle. Further, in each drawing, arrows $d_1$, $d_2$, and/or $d_3$ are indicated as necessary. The arrow $d_1$ indicates a toe-heel direction (left-right direction), the arrow $d_2$ indicates a top-sole direction (up-down direction), and the arrow $d_3$ indicates a face-back direction (front-rear direction).

The golf cub head 1 illustrated in FIGS. 1 to 4 is a cavity-back iron type golf club head. The golf club head 1 can be applied to any one of long irons, middle irons, short irons, or wedges. Note that a 6 iron, which is a middle iron, is illustrated as an example in FIGS. 1 to 4.

The golf club head 1 may be made of a metal material, for example, soft iron, stainless steel, titanium, aluminum, or chromium-molybdenum steel. The golf club head 1 can be manufactured by, for example, forging, casting, machining, or by a combination thereof. However, the manufacturing method is not limited to these methods.

The golf club head 1 includes a face portion 11, a protrusion 12, a sole portion 13, a top portion 14, and a hosel portion 15. The face portion 11 includes a front face 11*f* that serves as a ball striking face configured to strike a ball and a rear face 11*h* that faces away from the front face 11*f*. The face portion 11 has a prescribed thickness. Note that the front surface 11*f* may also be referred to as the ball striking face.

A plurality of score lines 11*s* (grooves recessed from the front face 11*f* toward the rear face 11*h*) having the toe-heel direction as the lengthwise direction are arrayed on the front face 11*f* at predetermined intervals in the top-sole direction. Each score line 11*s* is parallel to the horizontal plane H. In the face portion 11, the area where the plurality of score lines 11*s* are formed on the front face 11*f* is the part that is to strike a golf ball. Note that a center line Sc indicates the center line of the longest score lines his provided on the front face 11*f* of the face portion 11 in the toe-heel direction. The center line Sc runs through the center of the most sole-ward score line his in the toe-heel direction, and is perpendicular to each score line his.

A cavity portion 16 is provided behind the face portion 11. More specifically, the cavity portion 16 is defined by a thick section of the rear face 11*h* provided to surround the back side of the face portion 11 and a thin section of the rear face 11*h* provided at the center. The thickness of the face portion 11 where the cavity portion 16 is provided may or may not be uniform. In the example of FIG. 3, the thickness of the face portion 11 where the cavity portion 16 is provided has three levels of thickness that increases toward the sole side. That is, the face portion 11 includes, at where the cavity portion 16 is provided, a first part 111, a second part 112, and a third part 113 that are arranged sequentially from the top side toward the sole side. The second part 112 of the face portion 11 is thicker than the first part 111 of the face portion 11, and the third part 113 of the face portion 11 is even thicker than the second part 112 of the face portion 11. In this manner, the thickness of the face portion 11 where the cavity portion 16 is provided increases toward the sole, thus enabling the golf club head 1 to have a low center of gravity.

The protrusion 12 is provided at a lower part of the rear face 11*h* of the face portion 11. The protrusion 12 constitutes part of the back surface of the golf club head 1. The protrusion 12 protrudes toward the back side from the lower part of the rear face 11*h* of the face portion 11. The protrusion 12 extends from the toe side to the heel side. The protrusion 12 extends further toward the back side with respect to the cavity portion 16 when viewed in the top-sole direction. The protrusion 12 includes an upper surface 12*a*.

The sole portion 13 is a portion forming the bottom of the golf club head 1. The top portion 14 is a portion extending rearward from the upper end of the face portion 11. The top portion 14 is provided so as to face a part of the protrusion 12 with the cavity portion 16 interposed therebetween in the top-sole direction. The top portion 14 extends from the toe side to the heel side. The hosel portion 15 is a portion configured to be coupled to a shaft.

The protrusion 12 includes a first recess 121, the second recess 122, and a thick portion 123. The first recess 121 is provided closer to the heel side than the second recess 122 is, and extends from the upper surface 12*a* of the protrusion 12 to the sole side. The second recess 122 is provided closer to the toe side than the first recess 121 is, and extends from the upper surface 12*a* of the protrusion 12 to the sole side. The first recess 121 and the second recess 122 are arranged such that their lengthwise direction corresponds to the toe-heel direction.

In this manner, providing the first recess 121 and the second recess 122 in the protrusion 12 can reduce the weight of the golf club head 1. Hence, the size of the golf club head 1 can be increased without increasing the weight of the entire golf club head 1. Furthermore, it is possible to increase the weight on the toe side and the heel side of the golf club head 1 and to enlarge the sweet spot of the golf club head 1 without increasing the weight of the entire golf club head 1.

The thick portion 123 includes an upper surface 123*a*. The upper surface 123*a* of the thick portion 123 forms a part of the upper surface 12*a* of the protrusion 12. The thick portion 123 is a portion that is provided on the sole side relative to the upper surface 123*a*. The thick portion 123 is provided between the first recess 121 and the second recess 122 in the toe-heel direction. The thick portion 123 is positioned behind the center line Sc of the longest score lines 11*s*.

In this manner, in the protrusion 12, the thick portion 123, which is thicker than the areas where the first recess 121 and the second recess 122 are provided, is provided behind the center line Sc of the longest score lines 11*s*. Hence, the feel can be improved when a golf ball is struck near the center of the front face 11*f*.

As illustrated in FIG. 4, each of the first recess 121 and the second recess 122 is provided so as to have a substantially trapezoidal shape extending in the toe-heel direction when the rear face 11*h* of the face portion 11 is viewed in a direction perpendicular to the front face 11*f*. That is, the first recess 121 and the second recess 122 each have a substantially trapezoidal shape in a cross-sectional view taken along a plane that is parallel to the front face 11*f* of the face portion 11 and that passes through the deepest part of the first recess 121 and the deepest part of the second recess 122.

The first recess 121 and the second recess 122 each have a width in the toe-heel direction, the width being widest toward the upper surface 12*a* of the protrusion 12 and gradually decreasing toward the sole side. Each of the first recess 121 and the second recess 122 has an approximately uniform width in the face-back direction. The width of the first recess 121 in the face-back direction is approximately equal to the width of the second recess 122 in the face-back direction.

Note that the "substantially" trapezoidal shape includes a configuration in which a pair of opposing surfaces that correspond to the upper base and the lower base of a trapezoid are not parallel to each other. That is, "the upper surface 12*a* and a first bottom surface 121*a* of the first recess", which correspond to the upper base and the lower base of a trapezoid, may be configured such that the upper surface 12*a* is not parallel to the first bottom surface 121*a*. Furthermore, "the upper surface 12*a* and a second bottom surface 122*a* of the second recess", which correspond to the upper base and the lower base of a trapezoid, may be configured such that the upper surface 12*a* is not parallel to the second bottom surface 122*a*. More specifically, the "substantially" trapezoidal shape includes a configuration in which the upper base and the lower base are inclined in a range of ±10 degrees. The upper base, the lower base, and/or the legs may or may not be perfectly straight. For example, the upper base, the lower base, and/or the legs may have partial undulation or the ends of the lower base, and/or the legs may be rounded. Furthermore, in the first recess 121 and the second recess 122, the upper surface 12*a* of the protrusion 12 may be slightly curved in the top direction at a heel-side end of the first recess 121 and a toe-side end of the second recess 122 in accordance with the shape of the cavity portion 16 as illustrated in FIG. 4.

As illustrated in FIG. 4, an imaginary plane A1 extends from the upper surface 123*a* of the thick portion 123 in the toe-heel direction. An imaginary plane A2 indicates an imaginary plane that is inclined with respect to the imaginary plane A1. The distance between the imaginary plane A1 and the imaginary plane A2 is smallest on the toe side and gradually increases toward the heel side. More specifically, the angle of inclination of the imaginary plane A1 with respect to the imaginary plane A2 preferably falls in a range greater than 0 degrees and less than 10 degrees, and more preferably falls in a range greater than 1 degree and less than 5 degrees.

The first recess 121 and the second recess 122 gradually become deeper from the toe side toward the heel side. Forming the first recess 121 and the second recess 122 in such a shape can increase the moment of inertia. As a result, when the golf club head 1 hits a golf ball, the golf club head 1 is more resistant to twisting even if the golf ball is hit at a position that is off the center of gravity of the golf club head 1. This can reduce deviation from the launch direction, curving of the ball flight trajectory, and loss in flight distance.

The first bottom surface 121*a* of the first recess 121 and the second bottom surface 122*a* of the second recess 122 each may be inclined with respect to the imaginary plane A1. In such a case, the first bottom surface 121*a* of the first recess 121 and the second bottom surface 122*a* of the second recess 122 may be positioned on the same plane as the imaginary plane A2. Note, however, that this is merely an example. The first bottom surface 121*a* of the first recess 121 and the second bottom surface 122*a* of the second recess 122 need not be positioned on the same plane as long as the first recess 121 and the second recess 122 gradually become deeper from the toe side toward the heel side. In a case where the first bottom surface 121*a* and the second bottom surface 122*a* each have a curved surface, assume that reference numbers 121*a* and 122*a* indicated by broken lines in FIG. 4 each illustrate the deepest position of the bottom surface.

By making the first recess 121 and the second recess 122 substantially trapezoidal in shape and tilting each of the first bottom surface 121*a* of the first recess 121 and the second bottom surface 122*a* of the second recess 122 with respect to the imaginary plane A1, fine adjustments can be made with respect to the function of the golf club and to the feel of the golf club at impact. For example, referring to FIG. 4, in the first recess 121, the angle of inclination of the toe-side and/or heel-side inner wall surface 121*b* with respect to the upper surface 123*a* of the thick portion 123 can be adjusted so as to change the moment of inertia and the feel at impact. In a similar manner, for example, referring to FIG. 4, in the second recess 122, the angle of inclination of the toe-side and/or heel-side inner wall surface 122*b* with respect to the upper surface 123*a* of the thick portion 123 can be adjusted so as to change the moment of inertia and the feel at impact.

As illustrated in FIG. 3, in a cross-sectional view taken along the face-back direction, each of the first recess 121 and the second recess 122 may include a face-side inner wall surface and a back-side inner wall surface that are not parallel to the front face 11*f* of the face portion 11. Such a configuration can increase the depth of the center of gravity of the golf club head 1.

For example, in the cross-section illustrated in FIG. 3, the face-side inner wall surface and the back-side inner wall surface of the second recess 122 are not parallel to the front face 11*f*, but are inclined so as to become closer to the face portion 11 increasingly toward the sole side. The inner wall surfaces of the first recess 121 can also be inclined in the same direction as the inner walls of the second recess 122.

Letting L1 be a distance from the front face 11*f* of the face portion 11 to the face-side end of each of the first recess 121 and the second recess 122 and L2 be a face-to-back distance, it is preferable for the value of L1/L2×100 to be 20% or more and 30% or less. The first recess 121 and the second recess 122 can be provided at positions close to the face portion 11 in the face-back direction within this range. As a result, the depth of the center of gravity of the golf club head 1 can be increased. Note that the face-to-back distance represents the distance from the front face 11*f* to a back-side end portion where the distance becomes longest when measurement is performed in a direction perpendicular to the front face 11*f*.

[Set of Golf Clubs]

Figure 5:
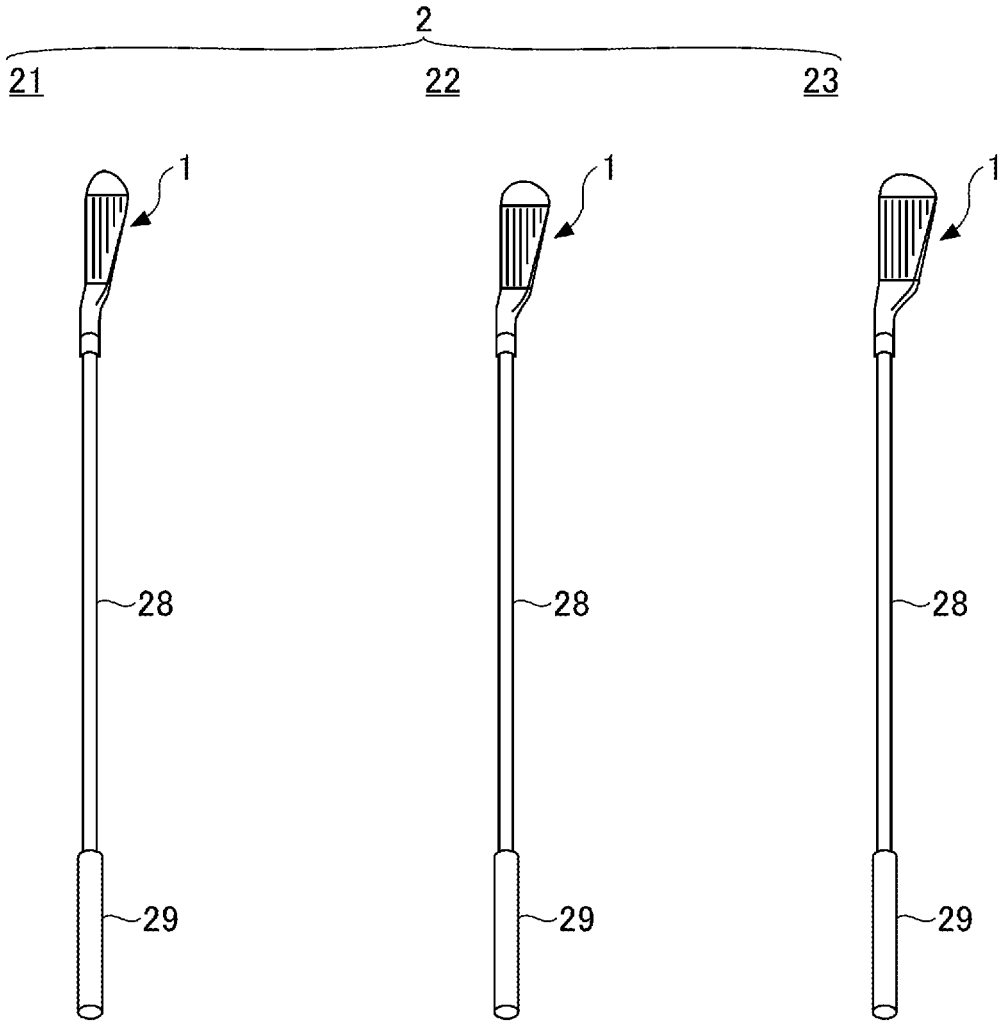
FIG. 5 is a view illustrating a set of golf clubs according to the embodiment.

FIG. 5 is a view illustrating an example of a set of golf clubs according to the embodiment. A golf club set 2 illustrated in FIG. 5 is a set of a plurality of golf clubs that include the cavity-back iron type golf club head 1. The golf club set 2 (the set of golf clubs) includes a first golf club 21, a second golf club 22, and a third golf club 23.

The first golf club 21 is one or more golf clubs including the golf club head 1 with a loft angle of 23 degrees or more and 30 degrees or less. The second golf club 22 is one or more golf clubs including the golf club head 1 with a loft angle of 30.5 degrees or more and 39 degrees or less. The third golf club 23 is one or more golf clubs including the golf club head 1 with a loft angle of 39.5 degrees or more. The first golf club 21, the second golf club 22, and the third golf club 23 may have the same lie angle.

In addition to the golf club head 1, each of the first golf club 21, the second golf club 22, and the third golf club 23 includes a shaft 28 and a grip 29. The golf club head 1 is attached to one end of the shaft 28, and the grip 29 is attached to the other end of the shaft 28.

The first golf club 21 is, for example, a 5 iron, the second golf club 22 is, for example, a 7 iron, and the third golf club 23 is, for example, a 9 iron. Note, however, that these are merely examples, and the first golf club 21, the second golf club 22, and the third golf club 23 may include a plurality of golf clubs within the aforementioned ranges of loft angles.

For example, the first golf club 21 may include a 4 iron, a 5 iron, and a 6 iron. The second golf club 22 may include a 7 iron and an 8 iron. The third golf club 23 may include a 9 iron and a pitching wedge.

Figure 6:
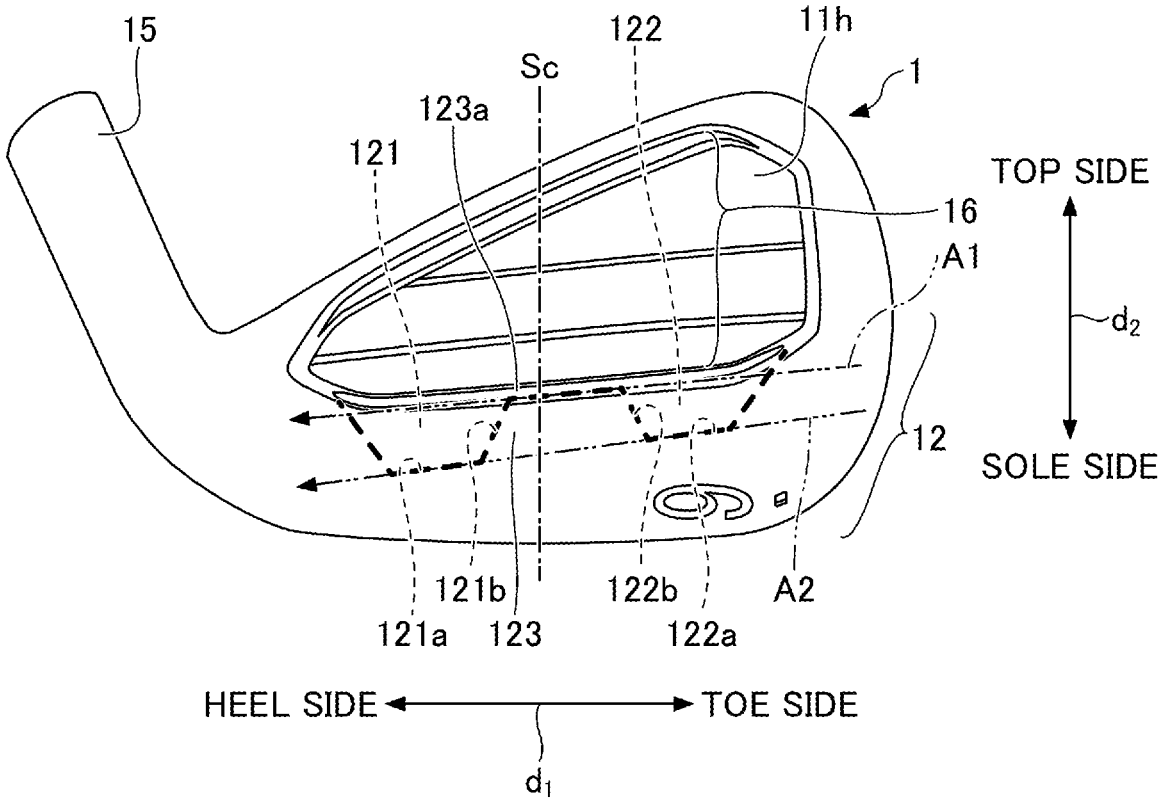
FIG. 6 is a rear view illustrating a 9 iron as an example of a third golf club.

FIG. 6 is a rear view illustrating a 9 iron as an example of the third golf club. In the golf club head 1 included by the third golf club 23 illustrated in FIG. 6, the upper surface 123*a* of the thick portion 123 has a width in the toe-heel direction that is greater than the width of the upper surface 123*a* of the thick portion 123 of the golf club head 1 included by the second golf club 22 illustrated in FIG. 4. In a similar manner, in the golf club head 1 included by the second golf club 22, the upper surface 123*a* of the thick portion 123 has a width in the toe-heel direction that is greater than the width of the upper surface 123*a* of the thick portion 123 of the golf club head 1 included by the first golf club 21.

That is, in the golf club set 2, the width, in the toe-heel direction, of the upper surface 123*a* of the thick portion 123 of the golf club head 1 satisfies the following relationship: the width of the upper surface of the thick portion of the third golf club 23>the width of the upper surface of the thick portion of the second golf club 22>the width of the upper surface of the thick portion of the first golf club 21. Therefore, the greater the loft angle is in the golf club, the better the feel is when a golf ball is struck.

Although the embodiment has been described above, the present disclosure is not limited to the specific embodiment disclosed above, and various modifications and changes can be implemented within the spirit and the scope of the disclosure disclosed in the appended claims.

What is claimed is:

1. A cavity-back iron type golf club head comprising:

a face portion;

a cavity portion provided behind the face portion; and a protrusion provided on a lower part of a rear face of the face portion, wherein the protrusion includes a first recess extending from an upper surface of the protrusion to a sole side, a second recess positioned closer to a toe side than the first recess is and extending from the upper surface of the protrusion to the sole side, and a thick portion provided between the first recess and the second recess in a toe-heel direction, wherein the first recess and the second recess each has a substantially trapezoidal shape in a cross-sectional view taken along a plane that is parallel to a front face of the face portion and that passes through a deepest part of the first recess and a deepest part of the second recess, wherein the first recess and the second recess each gradually become deeper from the toe side toward a heel side, wherein the thick portion is positioned behind a center line of a score line provided on the front face of the face portion in the toe-heel direction, and wherein in a cross-sectional view taken along a face-back direction, the first recess and the second recess each include a face-side inner wall surface and a back-side inner wall surface that are not parallel to the front face of the face portion.

2. The cavity-back iron type golf club head as claimed in claim 1, wherein the face portion has three levels of thickness where the cavity portion is provided.

3. The cavity-back iron type golf club head as claimed in claim 1, wherein the face portion has a thickness where the cavity portion is provided, the thickness of the face portion increasing toward the sole side.

4. The cavity-back iron type golf club head as claimed in claim 1, wherein a first bottom surface of the first recess and a second bottom surface of the second recess each are inclined with respect to an imaginary plane extending from an upper surface of the thick portion along the toe-heel direction.

5. The cavity-back iron type golf club head as claimed in claim 1, wherein a bottom surface of the first recess and a bottom surface of the second recess are positioned on a same plane.

6. A cavity-back iron type golf club head comprising:

a face portion;

a cavity portion provided behind the face portion; and a protrusion provided on a lower part of a rear face of the face portion, wherein the protrusion includes a first recess extending from an upper surface of the protrusion to a sole side, a second recess positioned closer to a toe side than the first recess is and extending from the upper surface of the protrusion to the sole side, and a thick portion provided between the first recess and the second recess in a toe-heel direction, wherein the first recess and the second recess each has a substantially trapezoidal shape in a cross-sectional view taken along a plane that is parallel to a front face of the face portion and that passes through a deepest part of the first recess and a deepest part of the second recess, wherein the first recess and the second recess each gradually become deeper from the toe side toward a heel side, wherein the thick portion is positioned behind a center line of a score line provided on the front face of the face portion in the toe-heel direction, and wherein letting L1 be a distance from the front face of the face portion to a face-side end of each of the first recess and the second recess and L2 be a face-to-back distance, a value of $L1/L2\times100$ is 20% or more and 30% or less.

7. A set of golf clubs comprising a plurality of golf clubs including a cavity-back iron type golf club head, wherein the plurality of golf clubs include one or more first golf clubs including a golf club head that has a loft angle of 23 degrees or more and 30 degrees or less, one or more second golf clubs including a golf club head that has a loft angle of 30.5 degrees or more and 39 degrees or less, and one or more third golf clubs including a golf club head that has a loft angle of 39.5 degrees or more, wherein the golf club head of the first golf club, the golf club head of the second golf club, and the golf club head of the third golf club each include a face portion, a cavity portion provided behind the face portion, and a protrusion provided on a lower part of a rear face of the face portion, wherein the protrusion includes a first recess extending from an upper surface of the protrusion to a sole side, a second recess positioned closer to a toe side than the first recess is and extending from the upper surface of the protrusion to the sole side, and a thick portion provided between the first recess and the second recess in a toe-heel direction, wherein the first recess and the second recess each has a substantially trapezoidal shape in a cross-sectional view taken along a plane that is parallel to a front face of the face portion and that passes through a deepest part of the first recess and a deepest part of the second recess, wherein the first recess and the second recess each gradually become deeper from the toe side toward a heel side, and wherein the thick portion is positioned behind a center line of a score line provided on the front face of the face portion in the toe-heel direction, and wherein a width, in the toe-heel direction, of an upper surface of the thick portion satisfies a relationship in which the width of the upper surface of the thick portion of the third golf club>the width of the upper surface of the thick portion of the second golf club>the width of the upper surface of the thick portion of the first golf club.

* * * * *